US008598275B2

(12) United States Patent
Tutmark

(10) Patent No.: US 8,598,275 B2
(45) Date of Patent: Dec. 3, 2013

(54) HYDROPHOBIC THERMOPLASTIC POLYURETHANE AS A COMPATILIZER FOR POLYMER BLENDS FOR GOLF BALLS

(75) Inventor: Bradley C. Tutmark, Aloha, OR (US)

(73) Assignee: Nike, Inc., Beaverton, OR (US)

( * ) Notice: Subject to any disclaimer, the term of this patent is extended or adjusted under 35 U.S.C. 154(b) by 289 days.

(21) Appl. No.: 13/040,349

(22) Filed: Mar. 4, 2011

(65) Prior Publication Data

US 2011/0224019 A1 Sep. 15, 2011

Related U.S. Application Data

(60) Provisional application No. 61/312,282, filed on Mar. 10, 2010.

(51) Int. Cl.
*A63B 37/00* (2006.01)
*A63B 37/12* (2006.01)
*C08L 75/04* (2006.01)

(52) U.S. Cl.
USPC ..... 525/130; 525/90; 525/92 A; 525/92 C; 525/98; 473/374; 473/378

(58) Field of Classification Search
None
See application file for complete search history.

(56) References Cited

U.S. PATENT DOCUMENTS

| | | | | |
|---|---|---|---|---|
| 3,312,666 | A | 4/1967 | Knipp et al. | |
| 5,075,407 | A | 12/1991 | Cody et al. | |
| 5,169,561 | A | 12/1992 | Gentle et al. | |
| 5,436,295 | A * | 7/1995 | Nishikawa et al. | 525/92 C |
| 5,744,549 | A | 4/1998 | Lutz | |
| 5,997,417 | A | 12/1999 | Lutz | |
| 6,287,216 | B1 | 9/2001 | Boehm | |
| 6,435,986 | B1 | 8/2002 | Wu et al. | |
| 6,547,677 | B2 | 4/2003 | Sullivan et al. | |
| 6,806,347 | B2 | 10/2004 | Hogge et al. | |
| 6,811,497 | B1 | 11/2004 | Jones et al. | |
| 6,852,044 | B2 | 2/2005 | Sullivan et al. | |
| 7,014,574 | B2 | 3/2006 | Wu et al. | |
| 7,105,628 | B2 | 9/2006 | Kuntimaddi et al. | |
| 7,438,651 | B2 | 10/2008 | Sullivan et al. | |
| 7,601,079 | B2 | 10/2009 | Sullivan | |
| 2002/0119840 | A1 | 8/2002 | Higuchi et al. | |
| 2003/0220464 | A1 | 11/2003 | Wu et al. | |
| 2003/0226446 | A1 | 12/2003 | Simmons | |
| 2003/0236353 | A1 | 12/2003 | Rajagopalan | |
| 2004/0254298 | A1 * | 12/2004 | Kim et al. | 525/92 C |
| 2004/0262808 | A1 | 12/2004 | Wu et al. | |
| 2005/0197480 | A1 | 9/2005 | Temple et al. | |
| 2005/0197481 | A1 | 9/2005 | Temple et al. | |
| 2007/0129510 | A1 | 6/2007 | Kuntimaddi et al. | |
| 2009/0137342 | A1 | 5/2009 | Wu et al. | |
| 2009/0192262 | A1 | 7/2009 | Meltzer et al. | |
| 2009/0286624 | A1 | 11/2009 | Petrichko et al. | |
| 2009/0291777 | A1 | 11/2009 | Rajagopalan et al. | |
| 2011/0081991 | A1 | 4/2011 | Matsuda et al. | |
| 2011/0224018 | A1 | 9/2011 | Tutmark | |
| 2011/0224019 | A1 | 9/2011 | Tutmark | |
| 2011/0224023 | A1 | 9/2011 | Tutmark | |
| 2011/0224024 | A1 | 9/2011 | Tutmark | |

FOREIGN PATENT DOCUMENTS

| | | |
|---|---|---|
| WO | 01-39844 | 6/2001 |

OTHER PUBLICATIONS

Encyclopedia of Polymer Science and Engineering vol. 2; 1985; pp. 398-400.*
Encyclopedia of Polymer Science and Engineering vol. 4; 1985; p. 487.*
International Search Report and Written Opinion for PCT Application PCT/US2011/027168 mailed Jun. 24, 2011.
U.S. Appl. No. 13/040,355, Office Action dated Mar. 21, 2011.
U.S. Appl. No. 13/040,359, Office Action dated Mar. 21, 2013.
International Search Report and Written Opinion for PCT Application PCT/US2011/027336, mailed May 6, 2011.
Oertel, Polyurethane Handbook, pp. 596-613, dated 1993.
International Search Report and Written Opinion for PCT Application PT/US2011/027334, mailed May 6, 2011.

* cited by examiner

*Primary Examiner* — David Buttner
(74) *Attorney, Agent, or Firm* — Banner & Witcoff, Ltd.

(57) ABSTRACT

A golf ball has a layer comprising a compatibilized blend of thermoplastic polyurethane, polyolefin, and hydrophobic thermoplastic polyurethane. The layer may be part of the cover, for example an inner layer of a two-layer cover layer. The layer may be an intermediate layer between the core and the cover.

20 Claims, 4 Drawing Sheets

HYDROPHOBIC THERMOPLASTIC POLYURETHANE AS A COMPATILIZER FOR POLYMER BLENDS FOR GOLF BALLS

This application claims benefit from U.S. Provisional application No. 61/312,282, filed Mar. 10, 2010, the whole contents of which are incorporated herein by reference in its entirety.

FIELD OF THE INVENTION

The present invention relates to golf balls. Particular aspects of this invention relate to golf balls prepared with polymer blends prepared with hydrophobic thermoplastic polyurethane compatibilizing agents.

BACKGROUND

Golf is enjoyed by a wide variety of players—players of different genders and dramatically different ages and/or skill levels. Golf is unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rate measurement technology, ball fitting technology, etc.).

Modern golf balls generally comprise either a one-piece construction or several layers including an outer cover surrounding a core. Some golf ball layers include a thermoplastic elastomer (e.g. polyurethane (TPU)) or polyolefin type materials. The urethane-type polymer is preferred by skilled players and professionals due to its high spin characteristics with short irons and around the green. However, urethane cover materials affect the ball in a negative way in that the Water Vapor Transmission Rate (WVTR) is approximately 1 to 2 orders of magnitude greater than (ionomer) materials. This problem arises when moisture penetrates the ball over time, hardening the ball's rubber core or any other rubber layer. This will ultimately change the balls performance. Polyolefins are desired for their excellent rebound characteristics. However, polyolefin-based materials tend to have poor scuff performance, i.e. they are scuffed easily when struck by the face of a golf club. Particularly wedges and short irons which are designed to generate spin on the ball.

It would be desirable to combine a thermoplastic elastomer such as TPU and polyolefins to provide a polymer blend having both excellent spin and durability characteristics as well as excellent rebound characteristics. However TPU and polyolefin are generally immiscible and hence incompatible. This results in unacceptable materials having poor properties. Moreover, a layer prepared from this type of blend tends to delaminate within itself. It would be desirable to provide a blend of TPU and polyolefins in order to provide the desired characteristics from each.

While the industry has witnessed dramatic changes and improvements to golf equipment in recent years, some players continue to look for increased distance on their golf shots, particularly on their drives or long iron shots, and/or improved spin or control of their shots, particularly around the greens. Accordingly, there is room in the art for further advances in golf technology.

SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this invention are directed to golf balls having at least one layer prepared with a compatibilized blend comprising thermoplastic elastomer and a polyolefin, and an effective amount of a compatibilizing agent comprising hydrophobic thermoplastic polyurethane.

Aspects of this invention are directed to golf balls having at least one layer prepared with a compatibilized blend comprising thermoplastic polyurethane (TPU) and a polyolefin, and an effective amount of a compatibilizing agent comprising hydrophobic thermoplastic polyurethane.

Other aspects of this invention are directed to methods for applying a layer comprising the compatibilized blend.

BRIEF DESCRIPTION OF THE DRAWINGS

A more complete understanding of the present invention and certain advantages thereof may be acquired by referring to the following detailed description in consideration with the accompanying drawings, in which.

Figure 1:
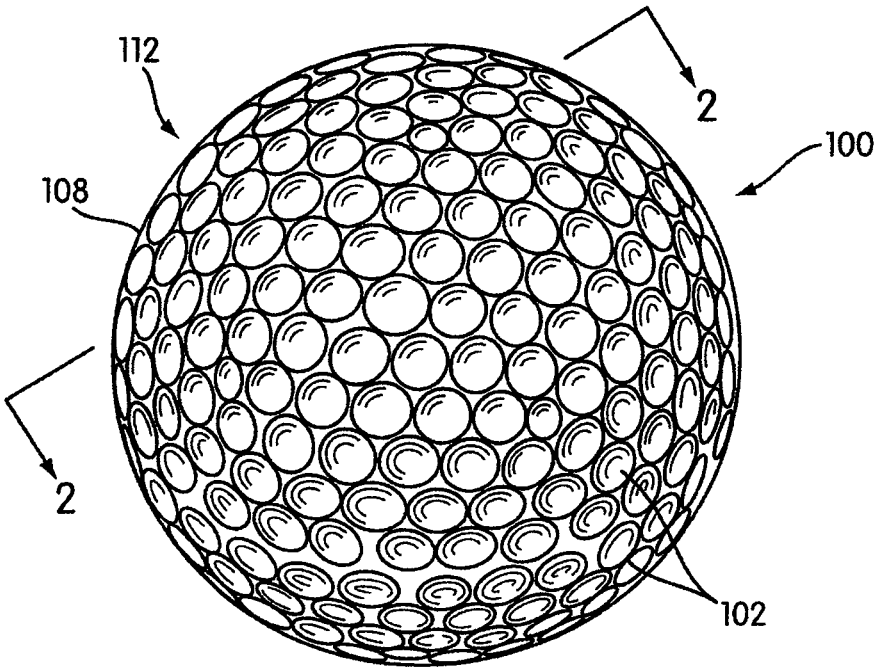
FIG. 1 schematically illustrates a golf ball having dimples.

The reader is advised that the various parts shown in these drawings are not necessarily drawn to scale.

DETAILED DESCRIPTION

In the following description of various example structures, reference is made to the accompanying drawings, which form a part hereof, and in which are shown by way of illustration various example golf ball structures. Additionally, it is to be understood that other specific arrangements of parts and structures may be utilized and structural and functional modifications may be made without departing from the scope of the present invention. Also, while terms such as "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures.

A. General Description of Golf Balls and Manufacturing Systems and Methods

Golf balls may be of varied construction, e.g., one-piece balls, two-piece balls, three-piece balls (including wound balls), four-piece balls, five-piece balls, etc. The difference in play characteristics resulting from these different types of constructions can be quite significant. Generally, golf balls may be classified as solid or wound balls. Solid balls that have a two-piece construction, typically a cross-linked rubber core, e.g., polybutadiene cross-linked with zinc diacrylate and/or similar cross-linking agents, encased by a blended cover, e.g., ionomer resins, are popular with many average recreational golfers. The combination of the core and cover materials provide a relatively "hard" ball that is virtually indestructible by golfers and one that imparts a high initial velocity to the ball, resulting in improved distance. Because the materials from which the ball is formed are very rigid, two-piece balls tend to have a hard "feel" when struck with a club. Likewise, due to their hardness, these balls have a relatively low spin rate, which also helps provide greater distance.

Wound balls are generally constructed from a liquid or solid center surrounded by tensioned elastomeric material and covered with a durable cover material, e.g., ionomer resin, or a softer cover material, e.g., balata or polyurethane. Wound balls are generally thought of as performance golf balls and have good resiliency, desirable spin characteristics, and good "feel" when struck by a golf club. However, wound balls are generally difficult to manufacture as compared to solid golf balls.

More recently, three- and four-piece balls have gained popularity, both as balls for average recreational golfers as well as performance balls for professional and other elite level players. Such balls typically include a core (optionally a multi-part core, such as an inner core and an outer core), one or more mantle or intermediate layers (also called "inner cover" layers), and an outer cover layer.

A variety of golf balls have been designed to provide particular playing characteristics. These characteristics generally include the initial velocity and spin of the golf ball, which can be optimized for various types of players. For instance, certain players prefer a ball that has a high spin rate in order to control and stop the golf ball around the greens. Other players prefer a ball that has a low spin rate and high resiliency to maximize distance. Generally, a golf ball having a hard core and a soft cover will have a high spin rate. Conversely, a golf ball having a hard cover and a soft core will have a low spin rate. Golf balls having a hard core and a hard cover generally have very high resiliency for distance, but they may "feel" hard and be difficult to control around the greens.

The carry distance of some conventional two-piece balls has been improved by altering the typical single layer core and single cover layer construction to provide a multi-layer ball, e.g., a dual cover layer, dual core layer, and/or a ball having an intermediate layer disposed between the cover and the core. Three- and four-piece balls are now commonly found and commercially available. Aspects of this invention may be applied to all types of ball constructions, including the wound, solid, and/or multi-layer ball constructions described above.

FIG. 1 is a perspective view of a solid golf ball 100 according to an aspect of the invention. Golf ball 100 may be generally spherical in shape with a plurality of dimples 102 arranged on the outer surface 108 of golf ball 100 in a pattern 112.

Internally, golf ball 100 may be generally constructed as a multilayer solid golf ball, having any desired number of pieces. In other words, multiple layers of material may be fused, blended, or compressed together to form the ball. The physical characteristics of a golf ball may be determined by the combined properties of the core layer(s), any optional mantle layers, and the cover. The physical characteristics of each of these components may be determined by their respective chemical compositions. The majority of components in golf balls comprise oligomers or polymers. The physical properties of oligomers and polymers may be highly dependent on their composition, including the monomer units included, molecular weight, degree of cross-linking, etc. Examples of such properties may include solubility, viscosity, specific gravity (SG), elasticity, hardness (e.g., as measured as Shore D hardness), rebound resilience, scuff resistance, etc. The physical properties of the oligomers and polymers used may also affect the industrial processes used to make the components of the golf ball. For example, where injection molding is the processing method used, extremely viscous materials may slow down the process and thus viscosity may become a limiting step of production.

Figure 2:
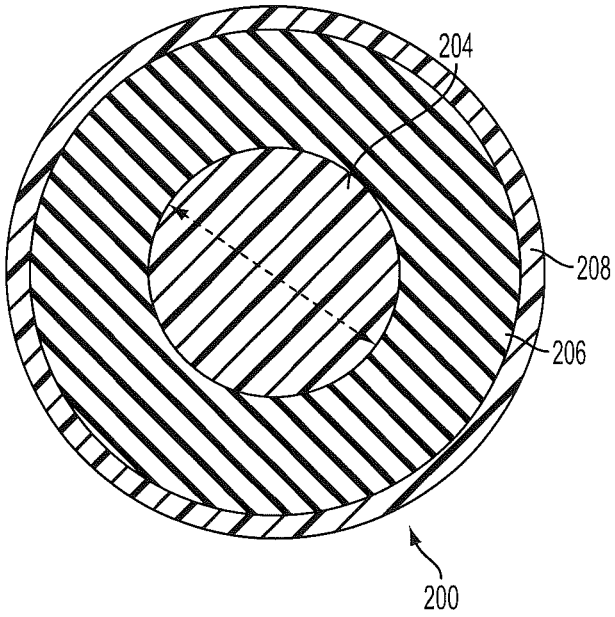
FIG. 2 schematically illustrates a cross-sectional view of a golf ball in accordance with FIG. 1.

As shown in FIG. 2, one aspect of such a golf ball (referred to generally as 200) includes a core 204, a cover 208, and an intermediate layer 206 between core 204 and cover 208. Cover 208 surrounds, encloses, encompasses, etc., the core and any other internal layers of the ball. Cover 208 has an outer surface that may include a dimple pattern comprising a plurality of dimples.

Figure 3:
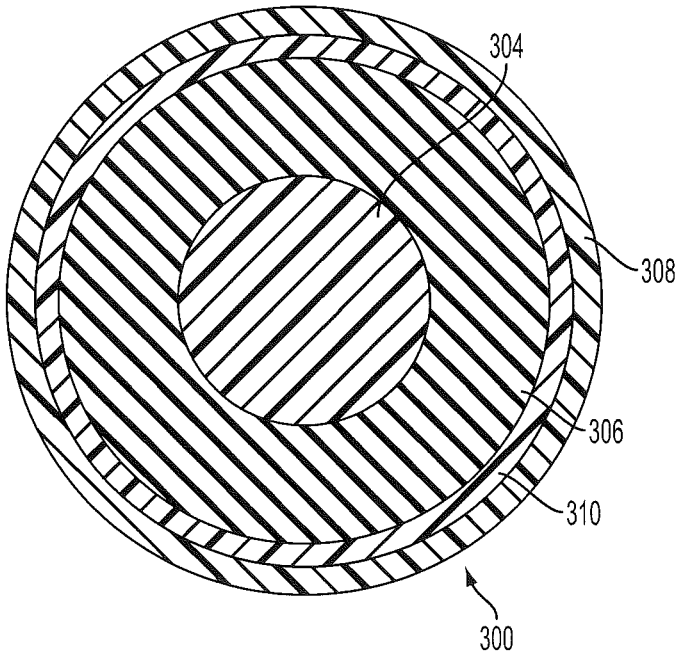
FIG. 3 schematically illustrates another cross-sectional view of a golf ball in accordance with FIG. 1.

As shown in FIG. 3, another aspect of such a golf ball (referred to generally as 300) includes a core 304, a cover 308, and intermediate layers 306 and 310 between core 304 and cover 308. Cover 308 surrounds, encloses, encompasses, etc., the core and any other internal layers of the ball. Cover 308 has an outer surface that may include a dimple pattern comprising a plurality of dimples.

The Center

A golf ball may be formed, for example, with a center having a low compression, but still exhibit a finished ball COR and initial velocity approaching that of conventional two-piece distance balls. The center may have, for example, a compression of about 60 or less. The finished balls made with such centers have a COR, measured at an inbound speed of 125 ft./s., of about 0.795 to about 0.815. "COR" refers to Coefficient of Restitution, which is obtained by dividing a ball's rebound velocity by its initial (i.e., incoming) velocity. This test is performed by firing the samples out of an air cannon at a vertical steel plate over a range of test velocities (e.g., from 75 to 150 ft/s). A golf ball having a high COR dissipates a smaller fraction of its total energy when colliding with the plate and rebounding therefrom than does a ball with a lower COR.

The terms "points" and "compression points" refer to the compression scale or the compression scale based on the ATTI Engineering Compression Tester. This scale, which is well known to persons skilled in the art, is used in determining the relative compression of a center or ball.

The center may have, for example, a Shore C hardness of about 40 to about 80. The center may have a diameter of about 0.75 inches to about 1.68 inches. The base composition for forming the center may include, for example, polybutadiene and about 20 to 50 parts of a metal salt diacrylate, dimethacrylate, or monomethacrylate. If desired, the polybutadiene can also be mixed with other elastomers known in the art, such as natural rubber, styrene butadiene, and/or isoprene, in order to further modify the properties of the center. When a mixture of elastomers is used, the amounts of other constituents in the center composition are usually based on 100 parts by weight of the total elastomer mixture. In other examples, the center (or core) may be made from resin materials, such as HPF resins (optionally with barium sulfate included therein), which are commercially available from E.I. DuPont de Nemours and Company of Wilmington, Del.

Metal salt diacrylates, dimethacrylates, and monomethacrylates include without limitation those wherein the metal is magnesium, calcium, zinc, aluminum, sodium, lithium or nickel. Zinc diacrylate, for example, provides golf balls with a high initial velocity in the United States Golf Association ("USGA") test.

Free radical initiators often are used to promote cross-linking of the metal salt diacrylate, dimethacrylate, or monomethacrylate and the polybutadiene. Suitable free radical initiators include, but are not limited to peroxide compounds, such as dicumyl peroxide; 1,1-di(t-butylperoxy) 3,3,5-trimethyl cyclohexane; bis(t-butylperoxy) diisopropylbenzene; 2,5-dimethyl-2,5'di(t-butylperoxy) hexane; or di-t-butyl peroxide; and mixtures thereof. The initiator(s) at 100 percent activity may be added in an amount ranging from about 0.05 to about 2.5 pph based upon 100 parts of butadiene, or butadiene mixed with one or more other elastomers. Often the amount of initiator added ranges from about 0.15 to about 2 pph, and more often from about 0.25 to about 1.5 pph. The golf ball centers may incorporate 5 to 50 pph of zinc oxide (ZnO) in a zinc diacrylate-peroxide cure system that cross-links polybutadiene during the core molding process.

The center compositions may also include fillers, added to the elastomeric (or other) composition to adjust the density and/or specific gravity of the center. Non-limiting examples of fillers include zinc oxide, barium sulfate, and regrind, e.g., recycled core molding matrix ground to about 30 mesh particle size. The amount and type of filler utilized is governed by the amount and weight of other ingredients in the composition, bearing in mind a maximum golf ball weight of 1.620 oz has been established by the USGA. Fillers usually range in specific gravity from about 2.0 to about 5.6. The amount of filler in the center may be lower such that the specific gravity of the center is decreased.

The specific gravity of the center may range, for example, from about 0.8 to about 1.3, depending upon such factors as the size of the center, cover, intermediate layer and finished ball, as well as the specific gravity of the cover and intermediate layer. Other components such as accelerators, e.g., tetra methylthiuram, processing aids, processing oils, plasticizers, dyes and pigments, antioxidants, as well as other additives well known to the skilled artisan may also be used in amounts sufficient to achieve the purpose for which they are typically used.

Intermediate Layer(s)

The golf ball also may have one or more intermediate layers formed, for example, from dynamically vulcanized thermoplastic elastomers, functionalized styrene-butadiene elastomers, thermoplastic rubbers, polybutadiene rubbers, natural rubbers, thermoset elastomers, thermoplastic urethanes, metallocene polymers, thermoset urethanes, ionomer resins, or blends thereof. For example, an intermediate layer may include a thermoplastic or thermoset polyurethane. Non-limiting of commercially available dynamically vulcanized thermoplastic elastomers include SANTOPRENE®, SARLINK®, VYRAM®, DYTRON®, and VISTAFLEX®. SANTOPRENE® is a dynamically vulcanized PP/EPDM. Examples of functionalized styrene-butadiene elastomers, i.e., styrene-butadiene elastomers with functional groups such as maleic anhydride or sulfonic acid, include KRATON FG-1901x and FG-1921x, which are available from the Shell Corporation of Houston, Tex.

Examples of suitable thermoplastic polyurethanes include ESTANE® 58133, ESTANE® 58134 and ESTANE® 58144, which are commercially available from Lubrizol of Cleveland, Ohio.

Examples of metallocene polymers, i.e., polymers formed with a metallocene catalyst, include those commercially available from Sentinel Products of Hyannis, Mass. Suitable thermoplastic polyesters include polybutylene terephthalate. Thermoplastic ionomer resins may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, low modulus ionomers such as acid-containing ethylene copolymer ionomers, include E/X/Y copolymers where E is ethylene, X is a softening comonomer such as acrylate or methacrylate. Non-limiting examples of ionomer resins include SURLYN® and IOTEK®, which are commercially available from DuPont and Exxon, respectively.

Alternatively, the intermediate layer(s) may be a blend of a first and a second component wherein the first component is a dynamically vulcanized thermoplastic elastomer, a functionalized styrene-butadiene elastomer, a thermoplastic or thermoset polyurethane or a metallocene polymer and the second component is a material such as a thermoplastic or thermoset polyurethane, a thermoplastic polyetherester or polyetheramide, a thermoplastic ionomer resin, a thermoplastic polyester, another dynamically vulcanized elastomer, another a functionalized styrene-butadiene elastomer, another a metallocene polymer or blends thereof. At least one of the first and second components may include a thermoplastic or thermoset polyurethane.

One or more intermediate layers also may be formed from a blend containing an ethylene methacrylic/acrylic acid copolymer. Non-limiting examples of acid-containing ethylene copolymers include ethylene/acrylic acid; ethylene/methacrylic acid; ethylene/acrylic acid/n- or isobutyl acrylate; ethylene/methacrylic acid/n- or iso-butyl acrylate; ethylene/acrylic acid/methyl acrylate; ethylene/methacrylic acid/methyl acrylate; ethylene/acrylic acid/iso-bornyl acrylate or methacrylate and ethylene/methacrylic acid/isobornyl acrylate or methacrylate. Examples of commercially available ethylene methacrylic/acrylic acid copolymers include NUCREL® polymers, available from DuPont.

Alternatively, the intermediate layer(s) may be formed from a blend which includes an ethylene methacrylic/acrylic acid copolymer and a second component which includes a thermoplastic material. Suitable thermoplastic materials for use in the intermediate blend include, but are not limited to, polyesterester block copolymers, polyetherester block copolymers, polyetheramide block copolymers, ionomer resins, dynamically vulcanized thermoplastic elastomers, styrene-butadiene elastomers with functional groups such as maleic anhydride or sulfonic acid attached, thermoplastic polyurethanes, thermoplastic polyesters, metallocene polymers, and/or blends thereof.

An intermediate layer often has a specific gravity of about 0.80 or more. In some examples the intermediate layer has a specific gravity greater than 1.0, e.g., ranging from about 1.02 to about 1.3. Specific gravity of the intermediate layer may be adjusted, for example, by adding a filler such as barium sulfate, zinc oxide, titanium dioxide and combinations thereof.

The intermediate layer blend may have a flexural modulus of less than about 15,000 psi, often from about 5,000 to about 8,000 psi. The intermediate layers often have a Shore D hardness of about 35 to 70. The intermediate layer and core construction together may have a compression of less than about 65, often from about 50 to about 65. Usually, the intermediate layer has a thickness from about 0.020 inches to about 0.2 inches. The golf balls may include a single intermediate layer or a plurality of intermediate layers. In the case where a ball includes a plurality of intermediate layers, a first intermediate layer outside the core may include, for example, a thermoplastic material or a rubber material (synthetic or natural) having a hardness greater than that of the core.

A second intermediate layer may be disposed around the first intermediate layer and may have a greater hardness than that of the first intermediate layer. The second intermediate layer may be formed of materials such as polyether or polyester thermoplastic urethanes, thermoset urethanes, and ionomers such as acid-containing ethylene copolymer ionomers.

In addition, if desired, a third intermediate layer (or even more layers) may be disposed in between the first and second intermediate layers. The third intermediate layer may be formed of the variety of materials as discussed above. For example, the third intermediate layer may have a hardness greater than that of the first intermediate layer.

The Cover Layer

A golf ball also typically has a cover layer that includes one or more layers of a thermoplastic or thermosetting material. A variety of materials may be used such as ionomer resins, thermoplastic polyurethanes, balata and blends thereof.

The cover may be formed of a composition including very low modulus ionomers (VLMIs). As used herein, the term "very low modulus ionomers," or the acronym "VLMIs," are those ionomer resins further including a softening comonomer X, commonly a (meth)acrylate ester, present from about 10 weight percent to about 50 weight percent in the polymer. VLMIs are copolymers of an α-olefin, such as ethylene, a softening agent, such as n-butyl-acrylate or iso-butyl-acrylate, and an α, β-unsaturated carboxylic acid, such as acrylic or methacrylic acid, where at least part of the acid groups are neutralized by a magnesium cation. Other examples of softening comonomers include n-butyl methacrylate, methyl acrylate, and methyl methacrylate. Generally, a VLMI has a flexural modulus from about 2,000 psi to about 10,000 psi. VLMIs are sometimes referred to as "soft" ionomers.

Ionomers, such as acid-containing ethylene copolymer ionomers, include E/X/Y copolymers where E is ethylene, X is a softening comonomer such as acrylate or methacrylate present in 0 to 50 weight percent of the polymer, and Y is acrylic or methacrylic acid present in 5 to 35 (often 10 to 20) weight percent of the polymer, wherein the acid moiety is neutralized 1 to 90 percent (usually at least 40 percent) to form an ionomer by a cation such as lithium, sodium, potassium, magnesium, calcium, barium, lead, tin, zinc or aluminum, or a combination of such cations, lithium, sodium and zinc being the most preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

To aid in the processing of the cover stock, ionomer resins may be blended in order to obtain a cover having desired characteristics. For this reason, the cover may be formed from a blend of two or more ionomer resins. The blend may include, for example, a very soft material and a harder material. Ionomer resins with different melt flow indexes are often employed to obtain the desired characteristics of the cover stock. SURLYN® 8118, 7930 and 7940 have melt flow indices of about 1.4, 1.8, and 2.6 g/10 min., respectively. SURLYN® 8269 and SURLYN® 8265 each have a melt flow index of about 0.9 g/10 min. A blend of ionomer resins may be used to form a cover having a melt flow index, for example, of from about 1 to about 3 g/10 min. The cover layer may have a Shore D hardness, for example, ranging from about 20 to about 80.

The cover also may include thermoplastic and/or thermoset materials. For example, the cover may include a thermoplastic material such as urethane or polyurethane. Polyurethane is a product of a reaction between a polyurethane prepolymer and a curing agent. The polyurethane prepolymer is a product formed by a reaction between a polyol and a diisocyanate. Often, a catalyst is employed to promote the reaction between the curing agent and the polyurethane prepolymer. In the case of cast polyurethanes, the curing agent is typically either a diamine or glycol.

As another example, a thermoset cast polyurethane may be used. Thermoset cast polyurethanes are generally prepared using a diisocyanate, such as 2,4-toluene diisocyanate (TDI), methylenebis-(4-cyclohexyl isocyanate) (HMDI), or paraphenylene diisocyanate ("PPDI") and a polyol which is cured with a polyamine, such as methylenedianiline (MDA), or a trifunctional glycol, such as trimethylol propane, or tetrafunctional glycol, such as N,N,N',N'-tetrakis(2-hydroxpropyl)ethylenediamine. Other suitable thermoset materials include, but are not limited to, thermoset urethane ionomers and thermoset urethane epoxies. Other examples of thermoset materials include polybutadiene, natural rubber, polyisoprene, styrene-butadiene, and styrene-propylene-diene rubber.

When the cover includes more than one layer, e.g., an inner cover layer and an outer cover layer, various constructions and materials are suitable. For example, an inner cover layer may surround the intermediate layer with an outer cover layer disposed thereon or an inner cover layer may surround a plurality of intermediate layers. When using an inner and outer cover layer construction, the outer cover layer material may be a thermoset material that includes at least one of a castable reactive liquid material and reaction products thereof, as described above, and may have a hardness from about 30 Shore D to about 60 Shore D.

The inner cover layer may be formed from a wide variety of hard (e.g., about 50 Shore D or greater), high flexural modulus resilient materials, which are compatible with the other materials used in the adjacent layers of the golf ball. The inner cover layer material may have a flexural modulus of about 65,000 psi or greater. Suitable inner cover layer materials include the hard, high flexural modulus ionomer resins and blends thereof, which may be obtained by providing a cross metallic bond to polymers of monoolefin with at least one member selected from the group consisting of unsaturated mono- or di-carboxylic acids having 3 to 12 carbon atoms and esters thereof (the polymer contains 1 to 50 percent by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 weight percent of the polymer, and Y is acrylic or methacrylic acid present in 5-35 weight percent of the polymer, wherein the acid moiety is neutralized about 1-90 percent to form an ionomer by a cation such as lithium, sodium, potassium, magnesium, calcium, barium, lead, tin, zinc, or aluminum, or a combination of such cations. Specific examples of acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate.

Examples of other suitable inner cover materials include thermoplastic or thermoset polyurethanes, polyetheresters, polyetheramides, or polyesters, dynamically vulcanized elastomers, functionalized styrene-butadiene elastomers, metallocene polymers, polyamides such as nylons, acrylonitrile butadiene-styrene copolymers (ABS), or blends thereof.

Manufacturing Process

While golf balls in accordance with examples of this invention may be made in any desired manner without departing from this invention, including in conventional manners as are known and used in the art, one common technique for manufacturing golf balls is a laminate process. In order to form multiple layers around the center, a laminate is first formed. The laminate includes at least two layers and sometimes includes three layers. The laminate may be formed by mixing uncured core material to be used for each layer and calendar rolling the material into thin sheets. Alternatively, the laminate may be formed by mixing uncured intermediate layer material and rolling the material into sheets. The laminate sheets may be stacked together to form a laminate having three layers, using calender rolling mills. Alternatively, the sheets may be formed by extrusion.

A laminate also may be formed using an adhesive between each layer of material. For example, an epoxy resin may be used as adhesive. The adhesive should have good shear and tensile strength, for example, a tensile strength over about 1500 psi. The adhesive often has a Shore D hardness of less than about 60 when cured. The adhesive layer applied to the sheets should be very thin, e.g., less than about 0.004 inches thick.

Preferably, each laminate sheet is formed to a thickness that is slightly larger than the thickness of the layers in the finished golf ball. Each of these thicknesses can be varied, but all have a thickness of preferably less than about 0.1 inches. The sheets should have very uniform thicknesses.

The next step in the method is to form multiple layers around the center. This may be accomplished by placing two laminates between a top mold and a bottom mold. The laminates may be formed to the cavities in the mold halves. The laminates then may be cut into patterns that, when joined, form a laminated layer around the center. For example, the laminates may be cut into figure 8-shaped or barbell-like patterns, similar to a baseball or a tennis ball cover. Other patterns may be used, such as curved triangles, hemispherical cups, ovals, or other patterns that may be joined together to form a laminated layer around the center. The patterns may then be placed between molds and formed to the cavities in the mold halves. A vacuum source often is used to form the laminates to the mold cavities so that uniformity in layer thickness is maintained.

After the laminates have been formed to the cavities, the centers are then inserted between the laminates. The laminates are then compression molded about the center under conditions of temperature and pressure that are well known in the art. The mold halves usually have vents to allow flowing of excess layer material from the laminates during the compression molding process. As an alternative to compression molding, the core and/or intermediate layer(s) may be formed by injection molding or other suitable technique.

The next step involves forming a cover around the golf ball core. The core, including the center and any intermediate layers, may be supported within a pair of cover mold-halves by a plurality of retractable pins. The retractable pins may be actuated by conventional means known to those of ordinary skill in the art.

After the mold halves are closed together with the pins supporting the core, the cover material is injected into the mold in a liquid state through a plurality of injection ports or gates, such as edge gates or sub-gates. With edge gates, the resultant golf balls are all interconnected and may be removed from the mold halves together in a large matrix. Sub-gating automatically separates the mold runner from the golf balls during the ejection of the golf balls from mold halves.

The retractable pins may be retracted after a predetermined amount of cover material has been injected into the mold halves to substantially surround the core. The liquid cover material is allowed to flow and substantially fill the cavity between the core and the mold halves, while maintaining concentricity between the core and the mold halves. The cover material is then allowed to solidify around the core, and the golf balls are ejected from the mold halves and subjected to finishing processes, including coating, painting, and/or other finishing processes, including processes in accordance with examples of this invention, as will be described in more detail below.

B. General Description of Thermoplastic Elastomer/Polyolefin Blend Containing Hydrophobic TPU Hydrophobic TPU is an effective compatibilizer for blends of thermoplastic elastomers such as thermoplastic polyurethane (TPU) and polyolefins. A compatibilizer provides the ability to combine materials and produce a blend with acceptable and/or improved properties by making the materials compatible or miscible.

A compatibilized blend comprises thermoplastic elastomer, polyolefin, and an effective amount of hydrophobic thermoplastic polyurethane (hydrophobic TPU) as a compatibilizer. The compatibilized blend may form part of the cover layer, for example, an inner layer of the cover layer, or may form one of the intermediate or inner layers between the core and the cover layer. The compatibilized blend is applied to a golf ball in any suitable manner such as with a molding process step.

C. Aspects of Invention

An aspect of this invention relate to golf balls having a layer formed by a compatibilized blend of thermoplastic elastomer and polyolefin, and an effective amount of hydrophobic thermoplastic polyurethane (hydrophobic TPU) as a compatibilizer.

In one aspect the compatibilized blend is used as at least one intermediate layer of a golf ball. In other aspects, the compatibilized blend is used as at least one outer layer of a golf ball.

Given the general description of various example aspects of the invention provided above, more detailed descriptions of various specific examples of golf ball structures according to the invention are provided below.

D. Detailed Description of Example Golf Balls, and Methods According to Aspects of the Invention The following discussion and accompanying figures describe various example golf balls in accordance with aspects of the present invention. When the same reference number appears in more than one drawing, that reference number is used consistently in this specification and the drawings to refer to the same or similar parts throughout.

Aspects of the invention utilize a compatibilized blend of thermoplastic elastomer and polyolefin and an effective amount of a hydrophobic thermoplastic polyurethane (hydrophobic TPU) as a compatibilizer. In particular, the thermoplastic elastomer is thermoplastic polyurethane (TPU).

The compatibilized blend, as applied as at least one layer of a golf ball, provides effective moisture protection to the golf ball. In particular, the compatibilized blend provides a moisture barrier layer having a Water Vapor Transmission Rate (WVTR) of less than 1300, after 168 hrs at 25° C. and 50% relative humidity for instance of less than 1000, preferably less than 750.

The Shore D hardness of a layer formed by the compatibilized blend is between 20 and 65. "Shore D hardness" refers to a measure of the hardness of a material by a durometer, and especially the material's resistance to indentation. Shore D hardness may be measured with a durometer directly on the curved surface of the core, layer, cover, etc., according to ASTM method D2240. In other embodiments, the hardness may be measured using standard plaques.

If the compatibilized blend is applied as an inner or intermediate layer, the shore D hardness is generally between 30 and 65. If the compatibilized blend is applied as an inner layer of the cover layer, the shore D hardness is generally between 30 and 65. An alternative scale to Shore D is Shore A hardness. Shore A hardness is generally between 60 to 99.

The specific gravity of the layer is greater than 0.80. The specific gravity of the composite of layers of a golf ball should be sufficiently high enough to approach but not exceed the USGA limit of 1.620 oz. in order to have a USGA conforming ball. "Specific gravity (SG)" refers to the conventional meaning of the ratio of the density of a given solid (or liquid) to the density of water at a specific temperature and pressure.

Hydrophobic TPU is described in US Publication 20090192262 and is a semi crystalline, thermoplastic polyurethane which is comprised of the reaction product of (1) a hydrophobic polyol, (2) a polyisocyanate, and (3) a linear chain extender containing 5 carbon atoms or 7 to 12 carbon atoms; wherein the hydrophobic polyol has a number average molecular weight which is within the range of about 1,000 to about 4,000; wherein the semi crystalline, thermoplastic polyurethane has a weight average molecular weight which is within the range of 50,000 to 1,000,000; and wherein the semi crystalline, thermoplastic polyurethane has a melting point which is within the range of 80° C. to 150° C. US Publication 20090192262 is hereby incorporated by reference in its entirety.

The hydrophobic polyol can be a diol of a conjugated diolefin monomer, a polyisobutylene diol, a polyester polyol prepared from fatty diols and/or fatty diacids, or mixtures thereof. For instance, the hydrophobic polyol can be prepared from dimer fatty alcohols and/or dimer fatty acids. The diols of conjugated olefin monomers that can be used include hydrogenated polybutadienediols, and hydrogenated polyisoprene diol. Hydrogenated polybutadiene polyols are sold by Mitsubishi Chemical Corporation under the trade name POLYTAIL, and Kraton polyols sold by Kraton Polymers of Houston, Tex.

Dimeric acid polyester polyols may contain from about 18 to about 44 carbon atoms Dimer acids (and esters thereof) are a well known commercially available class of dicarboxylic acids (or esters). The dimer acid material will usually contain 26 to 44 carbon atoms. Particularly, examples include dimer acids (or esters) derived from $C_{18}$ and $C_{22}$ unsaturated monocarboxylic acids (or esters) which will yield, respectively, $C_{36}$ and $C_{44}$ dimer acids (or esters). Dimer acids derived from $C_{18}$ unsaturated acids, which include acids such as linoleic and linolenic are particularly well known (yielding $C_{36}$ dimer acids). The dimer acid products will normally also contain a proportion of trimer acids ($C_{54}$ acids when using $C_{18}$ starting acids), possibly even higher oligomers and also small amounts of the monomer acids. Several different grades of dimer acids are available from commercial sources and these differ from each other primarily in the amount of monobasic and trimer acid fractions and the degree of unsaturation. Priplast™ polyester polyols are branched $C_{36}$ dimerized fatty acids which are particularly useful as the hydrophobic polyol. Priplast™ polyester polyols are commercially available from Uniqema of Gouda, Netherlands. The hydrophobic polyol used in synthesizing the hydrophobic TPU will typically have a number average molecular weight which is within the range of about 1,500 to about 4,000 and a number average molecular weight which is within the range of about 2,000 to about 3,000.

The linear chain extender used in making the hydrophobic TPU will typically be of the structural formula:

$$HO\text{-}[CH_2]_n\text{-}OH$$

wherein n represents the integer 5 or an integer from 7 to 12. Accordingly, the linear chain extender may be selected from the group consisting of 1,5-pentane diol, 1,7-heptane diol, 1,8-octane diol, 1,9-nonane diol, 1,10-decane diol, 1,11-undecane diol, 1,12-dodecane diol, and mixtures thereof.

The polyisocyanate may be a diisocyanate such as aliphatic diisocyanates and aromatic diisocyanates. Multifunctional isocyanate compounds, i.e., triisocyanates, etc., which cause crosslinking, are generally avoided and thus the amount used, if any, is generally less than 4 mole percent and preferably less than 2 mole percent based upon the total moles of all of the various isocyanates used. Suitable diisocyanates include aromatic diisocyanates such as: 4,4'-methylene bis-(phenyl isocyanate) (MDI); m-xylene diisocyanate (XDI), phenylene-1-4-diisocyanate, naphthalene-1,5-diisocyanate, diphenylmethane-3,3'-dimethoxy-4,4'-diisocyanate, and toluene diisocyanate (TDI); as well as aliphatic diisocyanates such as isophorone diisocyanate (IPDI), 1,4-cyclohexyl diisocyanate (CHDI), decane-1,10-diisocyanate, and dicyclohexylmethane-4,4'-diisocyanate. Dimers and trimers of the above diisocyanates may also be used as well as a blend of two or more diisocyanates may be used.

The polyisocyanate may be in the form of a low molecular weight polymer or oligomer which is end capped with an isocyanate. For example, the hydroxyl terminated polyether intermediate described above may be reacted with an isocyanate-containing compound to create a low molecular weight polymer end capped with isocyanate. In the TPU art, such materials are normally referred to as pre-polymers. Such pre-polymers normally have a number average molecular weight (Mn) which is within the range of about 500 to about 10,000.

The mole ratio of the one or more diisocyanates is generally from about 0.95 to about 1.05, or from about 0.98 to about 1.03 moles per mole of the total moles of the one or more hydrophobic polyols and the one or more chain extenders. The molar ratio of the chain extender to the polyol will typically be within the range of about 0.3:1 to 10:1 and will more typically be within the range of about 0.4:1 to 5:1. The molar ratio of the chain extender to the polyol may be within the range of about 0:5:1 to 3:1 or the range of about 0.5:1 to 2:1.

US Publication 20090192262 further describes various processes of making the hydrophobic TPU. Any suitable method is acceptable for the present application.

Catalysts such as stannous and other metal carboxylates as well as tertiary amines may be used to prepare the hydrophobic TPU. Examples of metal carboxylates catalysts include stannous octoate, dibutyl tin dilaurate, phenyl mercuric propionate, lead octoate, iron acetylacetonate, magnesium acetylacetonate, and the like. Examples of tertiary amine catalysts include triethylene diamine, and the like. The amount of the one or more catalysts is generally from about 50 to about 100 parts by weight per million parts by weight of the end TPU polymer formed.

The weight average molecular weight (Mw) of the hydrophobic TPU polymer range from about 50,000 to about 500,000 Daltons, from about 100,000 to about 500,000 Daltons, and from about 120,000 to about 300,000 Daltons. The Mw of the TPU polymer is measured according to gel permeation chromatography (GPC) against polystyrene standard.

When a higher molecular weight hydrophobic TPU polymer is desired, it can be achieved by using a small amount of a cross linking agent having an average functionality greater than 2.0 to induce cross linking. The amount of cross linking agent used is less than 2 mole percent of the total moles of chain extender, or less than 1 mole percent. Less than 1 mole percent of the chain extender may be replaced with trimethylol propane (TMP). The cross linking is accomplished by adding a cross linking agent having an average functionality greater than 2.0 together with the hydrophobic polyol, the isocyanate compound, and chain extender in the reaction mixture to manufacture the TPU polymer. The amount of cross linking agent used in the reaction mixture to make the TPU polymer will depend on the desired molecular weight and the effectiveness of the particular cross linking agent used. Usually, less than 2.0 mole percent, or less than 1.0 mole percent, based on the total moles of chain extender used in making the TPU polymer are used. The level of cross linking agent used is generally from about 0.05 mole percent to about 2.0 mole percent based on the total moles of chain extender.

The cross linking agents can be any monomeric or oligomeric materials which have an average functionality of greater than 2.0 and have the ability to cross link the TPU polymer. Such materials are well known in the art of thermoset polyurethanes such as trimethylol propane (TMP) and pentaerythritol.

The hydrophobic TPU has a melting point which is within the range of about 80° C. to about 150° C. It will typically have a melting point which is within the range of about 90° C. to about 145° C., and will more typically have a melting point which is within the range of about 110° C. to about 140° C.

Hydrophobic TPU is effective as a compatibilizer for thermoplastic elastomer/polyolefin blends, in particular TPU/polyolefin blends.

The thermoplastic elastomers may be any suitable elastomer including but not limited to TPE, TPO, TPU, SEB, SBS, SEBS, PEBA, TPV, and TPR. In particular, the thermoplastic elastomer is thermoplastic polyurethane (TPU).

The TPU suitable for combining with the hydrophobic TPU is a product of a reaction between polyurethane prepolymer and a curing agent. The polyurethane prepolymer is a product formed by a reaction between a polyol and a diisocyanate. Often, a catalyst is employed to promote the reaction between the curing agent and the polyurethane prepolymer. Further chain extenders may be used to increase the molecular weight of the polyurethane.

"Polyisocyanate" refers to an organic molecule having two or more isocyanate functional groups (e.g., a diisocyanate). Polyisocyanates useful herein may be aliphatic or aromatic, or a combination of aromatic and aliphatic, and may include, but are not limited to, diphenyl methane diisocyanate (MDI), toluene diisocyanate (TDI), hexamethylene diisocyanate (HDI), dicyclohexylmethane diisocyanate ($H_{12}$MDI), isoprene diisocyanate (IPDI), etc.

"Polyol" refers to an organic molecule having two or more hydroxyl functional groups.

Catalysts such as stannous and other metal carboxylates as well as tertiary amines may be used to prepare the TPU. Examples of metal carboxylates catalysts include stannous octoate, dibutyl tin dilaurate, phenyl mercuric propionate, lead octoate, iron acetylacetonate, magnesium acetylacetonate, and the like. Examples of tertiary amine catalysts include triethylene diamine, and the like. The amount of the one or more catalysts is low, generally from about 50 to about 100 parts by weight per million parts by weight of the end TPU polymer formed "Chain extender" refers to an agent which increases the molecular weight of a lower molecular weight polyurethane to a higher molecular polyurethane. Chain extenders may include one or more diols such as ethylene glycol, diethylene glycol, butane diol, hexane diol, etc.; triols such as trimethylol propane, glycerol, etc.; and polytetramethylene ether glycol, etc.

The TPU generally has a Shore D hardness of between about 20 and about 60 and a specific gravity of greater than about 1.2. The TPU generally has a weight average molecular weight of from about 20,000 to about 500,000.

U.S. Pat. No. 6,054,533, hereby incorporated by reference, describes types of conventional thermoplastic polyurethanes and techniques for their synthesis. Examples of suitable thermoplastic polyurethanes include ESTANE® 58133, ESTANE® 58134 and ESTANE® 58144, which are commercially available from Lubrizol of Cleveland, Ohio.

The polyolefin utilized in such compatibilized blend may be made from olefin, monomers containing from 2 to about 6 carbon atoms, such as polyethylene (including high density polyethylene, low density polyethylene, linear low density polyethylene and the like), polypropylene (including atactic polypropylene, syndiotactic polypropylene, and blends of polypropylene with elastomers), polybutylene, and copolymers of such olefin monomers. The weight average molecular weight of such polyolefins is generally from about 40,000 to about 2,000,000, and preferably from about 100,000 to about 1,500,000.

The amount of the thermoplastic elastomers in the blend is from about 5 percent to about 95 percent by weight based upon the total weight of the thermoplastic elastomer and polyolefin, typically about 15 percent to about 85 percent, and also between 20 percent and about 80 percent, or between 30 percent and 70 percent, and the amount of the polyolefin is a complementary amount, generally from about 5 percent by weight to about 95 percent by weight based upon the total weight of the thermoplastic elastomer and polyolefin.

The amount of the compatibilizing agent of the present invention utilized to form the compatibilized blend depends upon the type of thermoplastic elastomers, the type of particular polyolefin, and the like. Generally, the amount of compatibilizing agent is from about 0.25 to about 15 parts by weight, typically about 0.5 or 0.75 to about 6 or 10 parts by weight for every 100 parts by weight of the thermoplastic elastomer and the polyolefin blend.

The thermoplastic elastomer, polyolefin, and hydrophobic TPU are mixed or blended in a suitable manner. The mixing can utilize conventional melt processing techniques and can either be batch or continuous such as through the use of a single or a twin screw extruder. The mixing temperature is generally above the melting point of the TPU, and the hydrophobic TPU. Such temperatures are generally from about 180° C. to about 240° C. The mixing time will naturally vary depending upon the amount of components being blended together, the mixing equipment used, and the mixing temperature.

Additional additives optionally may be incorporated into the compatibilized blend, such as flow additives, mar/slip additives, adhesion promoters, thickeners, gloss reducers, flexibilizers, cross-linking additives, isocyanates or other agents for toughening or creating scratch resistance, optical brighteners, UV absorbers, and the like. The amount of such additives usually ranges from 0 to about 20 wt %, often from 0 to about 6 wt %.

After being compatibilized, such thermoplastic polyolefin blends exhibit improved properties such as impact resistance, good tensile strength, low delamination, good tear resistance, low abrasion, and the like over noncompatibilized blends of the same two polymers as fully shown in the various examples.

The compatibilized blend is applied to a golf ball with one molding process step, for example. The method of applying the resin is not limited.

The thickness of the applied blend (after drying, curing, cooling, hardening, or setting) typically ranges from of about 0.5 to about 5.0 mm, and in some examples, from about 0.75 to about 3.0 mm.

The golf ball body of the present invention has no limitation on its structure and includes a one-piece golf ball, a two-piece golf ball, a multi-piece golf ball comprising at least three layers, and a wound-core golf ball. The present invention can be applied for all types of the golf ball.

EXAMPLE

Figure 4:
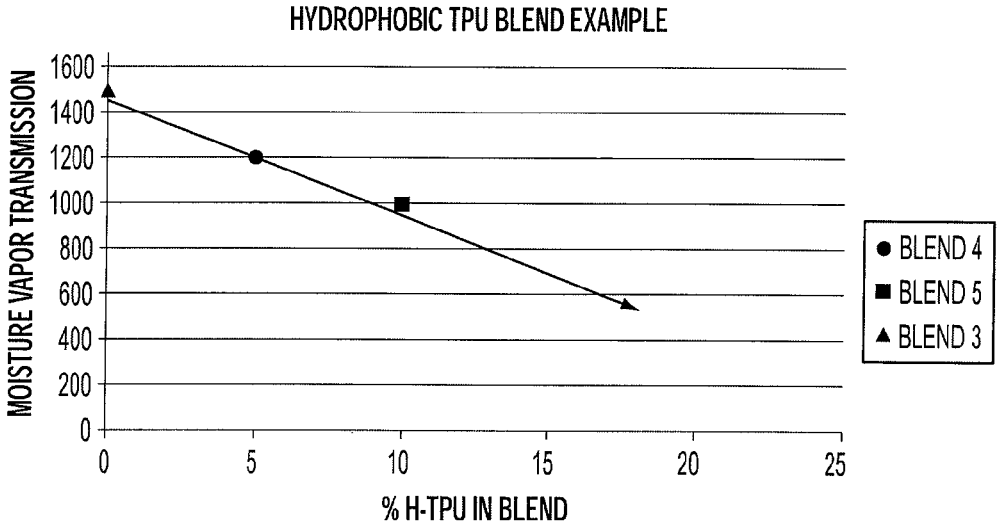
FIG. 4 provides Moisture Vapor Transmission Rates for various Hydrophobic TPU blends.

The tables below display 6 different blends and their corresponding Moisture Vapor Transmission Rates (WVTR). FIG. 4 displays the trend in vapor transmission as the % hydrophobic TPU (H-TPU) is increased from 0% to 5% to 10%. Blend 6 has the lowest transmission but is too hard.

Blends:

| | Existing Cover Blend | | | Reduced WVTR Blends | | |
|---|---|---|---|---|---|---|
| | Blend # | | | | | |
| Estane grade | 1 | 2 | 3 | 4 | 5 | 6 |
| 58219 | 75% | 50% | 40% | 63% | 60% | |
| 58280 | 25% | 50% | 60% | 32% | 30% | 25% |
| H-TPU | 0% | 0% | 0% | 5% | 10% | 0% |
| ETE 50DT3 | | | | | | 75% |

Performance:

| | Blend # | | | | | |
|---|---|---|---|---|---|---|
| | 1 | 2 | 3 | 4 | 5 | 6 |
| Shore A Hardness, 5 sec ASTM D2240 | 86 | 85 | 84 | 87 | 86 | 92 |
| Moisture vapor transmission, Upright Cup 25 C., 50% RH 5 mil film Loss, g/m2 after 168 hrs | 930 | 1100 | 1500 | 1200 | 1000 | 650 |

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with the figures may be used individually and/or in any combination or subcombination without departing from this invention.

I claim:

1. A golf ball, comprising:

a core;

an intermediate layer, and a cover layer;

wherein the intermediate layer comprises a compatibilized blend comprising thermoplastic elastomer and a polyolefin, and an effective amount of a compatibilizing agent comprising a semi-crystalline, hydrophobic thermoplastic polyurethane;

wherein the semi-crystalline, hydrophobic thermoplastic polyurethane comprises the reaction product of (1) a hydrophobic polyol, (2) a polyisocyanate, and (3) a linear chain extender containing 5 carbon atoms or 7 to 12 carbon atoms; wherein the hydrophobic polyol has a number average molecular weight that is within a range of about 1,000 to about 4,000; wherein the semi-crystalline, thermoplastic polyurethane has a weight average molecular weight that is within a range of 50,000 to 1,000,000; and wherein the semi-crystalline, thermoplastic polyurethane has a melting point that is within the range of 80° C. to 150° C.

2. The golf ball of claim 1 wherein the thermoplastic elastomer is thermoplastic polyurethane.

3. The golf ball of claim 1 wherein the intermediate layer has a Water Vapor Transmission Rate of less than 1300 g/m$^2$ after 168 hrs at 25C and 50% relative humidity.

4. The golf ball of claim 1 wherein the intermediate layer has a Water Vapor Transmission Rate of less than 1000 g/m$^2$ after 168 hrs at 25C and 50% relative humidity.

5. The golf ball of claim 1 wherein the intermediate layer has a Shore D hardness between 20 and 65.

6. The golf ball of claim 1 wherein the intermediate layer has a specific gravity of greater than 0.80.

7. The golf ball of claim 1 wherein the compatibilized blend is prepared with thermoplastic elastomer having a weight average molecular weight of from about 20,000 to about 500,000.

8. The golf ball of claim 1 wherein the compatibilized blend comprises from about 5 percent to about 95 percent by weight thermoplastic elastomer and from about 95 percent by weight to about 5 percent by weight polyolefin based on total weight of the thermoplastic elastomer and the polyolefin in the blend.

9. The golf ball of claim 1 wherein the effective amount of the compatibilized agent is from about 0.25 to about 15 parts by weight per 100 parts by total weight of the thermoplastic elastomer and the polyolefin in the blend.

10. A golf ball, comprising:

a core; and a cover;

wherein the cover comprises at least one layer comprising a compatibilized blend comprising thermoplastic elastomer and a polyolefin, and an effective amount of a compatibilizing agent comprising a semi-crystalline, hydrophobic thermoplastic polyurethane;

wherein the semi-crystalline, hydrophobic thermoplastic polyurethane comprises the reaction product of (1) a hydrophobic polyol, (2) a polyisocyanate, and (3) a linear chain extender containing 5 carbon atoms or 7 to 12 carbon atoms; wherein the hydrophobic polyol has a number average molecular weight that is within a range of about 1,000 to about 4,000; wherein the semi-crystalline, thermoplastic polyurethane has a weight average molecular weight that is within a range of 50,000 to 1,000,000; and wherein the semi-crystalline, thermoplastic polyurethane has a melting point that is within the range of 80° C. to 150° C.

11. The golf ball of claim 10 wherein the thermoplastic elastomer is thermoplastic polyurethane.

12. The golf ball of claim 10 wherein the cover layer has a Water Vapor Transmission Rate of less than 1300 g/m$^2$ after 168 hrs g/m$^2$ at 25C and 50% relative humidity.

13. The golf ball of claim 10 wherein the cover layer has a Water Vapor Transmission Rate of less than 1000 g/m$^2$ after 168 hrs at 25 C and 50% relative humidity.

14. The golf ball of claim 10 wherein the cover layer has a Shore D hardness between 20 and 50.

15. The golf ball of claim 10 wherein the cover layer has a specific gravity of greater than 0.80.

16. The golf ball of claim 10 wherein the compatibilized blend is prepared with thermoplastic elastomer having a weight average molecular weight of from about 20,000 to about 500,000.

17. The golf ball of claim 10 wherein the compatibilized blend comprises from about 5 percent to about 95 percent by weight thermoplastic elastomer and from about 95 percent by weight to about 5 percent by weight polyolefin based on total weight of the thermoplastic elastomer and the polyolefin in the blend.

18. The golf ball of claim 10 wherein the effective amount of the compatibilized agent is from about 0.25 to about 15 parts by weight per 100 parts by total weight of the thermoplastic elastomer and the polyolefin in the blend.

19. A method of preparing a golf ball comprising applying a compatibilized blend to a golf ball as an intermediate layer or cover layer, the compatibilized blend comprising thermoplastic elastomer and a polyolefin, and an effective amount of a compatibilizing agent comprising a semi-crystalline, hydrophobic thermoplastic polyurethane;

wherein the semi-crystalline, hydrophobic thermoplastic polyurethane comprises the reaction product of (1) a hydrophobic polyol, (2) a polyisocyanate, and (3) a linear chain extender containing 5 carbon atoms or 7 to 12 carbon atoms; wherein the hydrophobic polyol has a number average molecular weight that is within a range of about 1,000 to about 4,000; wherein the semi-crystalline, thermoplastic polyurethane has a weight average molecular weight that is within a range of 50,000 to 1,000,000; and wherein the semi-crystalline, thermoplastic polyurethane has a melting point that is within the range of 80° C. to 150° C.

20. The method of claim 19 wherein the layer comprising the compatibilized blend is molded onto a core or an intermediate layer of the golf ball.

* * * * *